US006106356A

United States Patent [19]

Trageser

[11] Patent Number: 6,106,356

[45] Date of Patent: Aug. 22, 2000

[54] TOY LOCOMOTIVE TRANSFORMABLE TO A CANNON

[75] Inventor: Mark Trageser, Los Angeles, Calif.

[73] Assignee: Mattel, Inc., El Segundo

[21] Appl. No.: 09/245,461

[22] Filed: Feb. 5, 1999

[51] Int. Cl.[7] ..... A63H 19/02; A63H 17/26

[52] U.S. Cl. ..... 446/72; 446/429; 446/467; 446/470; 446/487

[58] Field of Search ..... 446/72, 77, 78, 446/427, 428, 429, 430, 435, 467, 479, 471, 465, 486, 487

[56] References Cited

U.S. PATENT DOCUMENTS

| | | |
|---|---|---|
| D. 159,934 | 8/1950 | Sewell . |
| 1,813,985 | 7/1931 | Blackmore . |
| 2,674,989 | 4/1954 | Morsch . |
| 2,735,221 | 2/1956 | Fields . |
| 3,148,478 | 9/1964 | Miller . |
| 3,224,137 | 12/1965 | Wright et al. . |
| 3,240,201 | 3/1966 | Shelton . |
| 3,264,782 | 8/1966 | Glass et al. . |
| 4,382,347 | 5/1983 | Murakami . |
| 4,530,670 | 7/1985 | Ohno . |
| 5,248,274 | 9/1993 | Wang . |

*Primary Examiner*—Robert A. Hafer
*Assistant Examiner*—Laura Fossum
*Attorney, Agent, or Firm*—Roy A. Ekstrand

[57] ABSTRACT

A toy locomotive is configurable to provide a push toy resembling a locomotive and is alternatively configurable to provide a toy figure launching device. A cylindrical portion of the locomotive is pivotable to an upwardly inclined position above the supporting chassis of the toy locomotive. The cylindrical portion defines a cylindrical bore within which a piston is moveable. A spring loaded plunger and knob cooperated with the piston to facilitate drawing the piston into the cylindrical bore against a spring and thereafter releasing the plunger to transfer energy from the spring to the piston. A toy figure is receivable within the cylinder bore of the cylindrical portion so as to be projected or launched when the piston is released.

3 Claims, 2 Drawing Sheets

TOY LOCOMOTIVE TRANSFORMABLE TO A CANNON

FIELD OF THE INVENTION

This invention relates generally to toy vehicles and particularly to toy trains having an additional amusement feature.

BACKGROUND OF THE INVENTION

Toy trains are well known in the art and have proven to be extremely popular for many years. Such toys are often powered by a drive mechanism to provide so-called "self powered" toy trains. Different types of drive apparatus are utilized in operating such self powered toy trains. For example, a great many trains have been provided that utilize a spring driven wind-up motor to power the locomotive of the train. Similarly, small electric motor and battery power packs are sometimes used to provide operative power for propelling the toy train. A somewhat less popular type of drive mechanism is found in so-called "inertial motors". Inertial motors provide a large fly wheel having substantial weight which is operatively coupled to one or more of the toy train wheel. As the user rapidly moves the toy train across a play surface the fly wheel is spun at a high rate and continues to spin when the toy train is released. The energy stored in the rotating fly wheel then drives the toy train through the same gear mechanism used to accelerate the fly wheel when the toy train is pushed across a play surface.

A large number of toy trains are used with track sets. Toy train track sets have been subject to substantial variation however most utilize a loop of track having upwardly extending rails or downwardly extending groves which receive portions of the toy train wheels and guide the toy trains around the track loop. Other toy trains are configured for use without guiding rails or tracks and may be utilized upon virtually any play surface. Toy trains not intended to operated upon a track, are often push toys requiring that the user manually move the toy train about on the play surface.

To enhance play value and amusement of toy trains, practitioners in the art have often followed the lead of other types of toy vehicle providers. Thus for example, toy trains have been provided which utilize and entertainment feature such as lights, sound, action or fanciful activities such as shooting projectiles or the like.

For example, U.S. Pat. No. 3,264,782 issued to Glass et al. sets forth a SELF-PROPELLED TOY STEAM-TYPE LOCOMOTIVE having a toy train body supported upon a plurality of rolling wheels. The toy train body includes a battery powered drive mechanism operative upon at least one of the toy wheel to propel the locomotive. A passage is formed within the interior of the locomotive body and is operative to couple a plurality of light weight ball objects such as Ping-Pong balls or the like to a launching station. The launching station is positioned beneath the funnel of the engine and operates to periodically to fire the Ping-Pong balls upwardly through the smoke funnel.

U.S. Pat. No. 3,224,137 issued to Wright et al. sets forth a TOY CONSTRUCTION BLOCK SET having a pair of connectable chassis each supported by a plurality of rolling wheels. A plurality of construction blocks are securable to the chassis to construct a toy locomotive and a tender having a general appearance of a steam engine locomotive.

U.S. Pat. No. 2,735,221 issued to Fields sets forth a TOY WEAPON CARRIER having a toy vehicle body supported upon a plurality of rolling wheels. At least one of the wheels is operatively coupled to a gear drive mechanism which in turn repeatedly cocks and fires a toy weapon carrier having a projectile launchable therefrom.

U.S. Pat. No. 159,934 issued Sewell sets forth a ROCKET TANK TOY having a toy tank vehicle which supports an upwardly and forwardly extending projectile launcher. The projectile launcher receives a rocket-like projectile.

U.S. Pat. No. 3,148,478 issued to Miller sets forth a MISSILE LAUNCHER TOY having a toy chase supported by a plurality of rolling wheels. At least one of the wheels is coupled by a gear drive mechanism to a battery powered electric motor. Further operative means within the missile launcher toy cooperate to elevate and fire a toy missile and missile launcher.

U.S. Pat. No. 5,248,274 issued to Wang sets forth a TOY VEHICLE CAPABLE OF SHOOTING COLOR RIBBON CRACKERS having a master shooting member which is normally held by retaining means. When the bumper of the toy vehicle collides with a object it pushes against an impact link to disengage the retaining means from the master shooting member. This action permits a single impact to trigger a secondary shooting member having a percussion head dispersing colored ribbons from a color ribbon cracker mounted on the toy vehicle.

U.S. Pat. No. 4,530,670 issued to Ohno sets forth a RECONFIGURABLE TOY having a toy vehicle capable of being configured to simulate a van type truck or alternatively a robot-like figure.

U.S. Pat. No. 4,382,347 issued to Murakami sets forth TOY TRACTOR ASSEMBLY having the capability of being configured through a time control action into an alternate configuration. During the transformation, projectiles may be fired and a miniaturized vehicle may be release and propelled from the toy assembly.

U.S. Pat. No. 3,240,201 issued to Shelton sets forth a BALL PICK-UP AND PROJECTING TOY having a generally cylindrical body supported by a pair of wheels at the outer edges of the cylinder. A handle extends from the cylindrical body and is used to push the toy upon a play surface rolling the wheels. A mechanism within the cylinder is turned by the rolling wheels and operates to expel a ball object such as a Ping-Pong ball upwardly through a passage in the toy housing.

While the foregoing described prior art devices have improved the art and in some instances enjoyed commercial success, there remains nonetheless a continuing need in the art for ever more improved, interesting a cost effective toy locomotives.

SUMMARY OF THE INVENTION

Accordingly, it a object of the present invention to provide an improved toy locomotive. It is a more particular object of the present invention to provide an improved toy locomotive which utilizes an additional play feature to enhance the appeal of the toy. It is a still more particular object of the present invention to provide an improved toy locomotive which is transformable between a locomotive-like configuration and an alternate configuration.

In accordance with the present invention there is provided a transformable toy locomotive comprising: a chassis having a plurality of rolling wheels thereon; a cannon portion pivotally secured to the chassis movable between a first position lying upon the chassis and a second upwardly angled position, the cannon portion defining a cylindrical bore; a piston received within the cylindrical bore; a plunger joined to the piston; a spring coupled to the piston; a cab secured to the chassis in a first position and removable from the chassis in a second position; and a projectile receivable within the cylinder bore, the cab and the cannon portion cooperating to form a toy locomotive in their respective first positions and a cannon and target in their respective second configurations.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
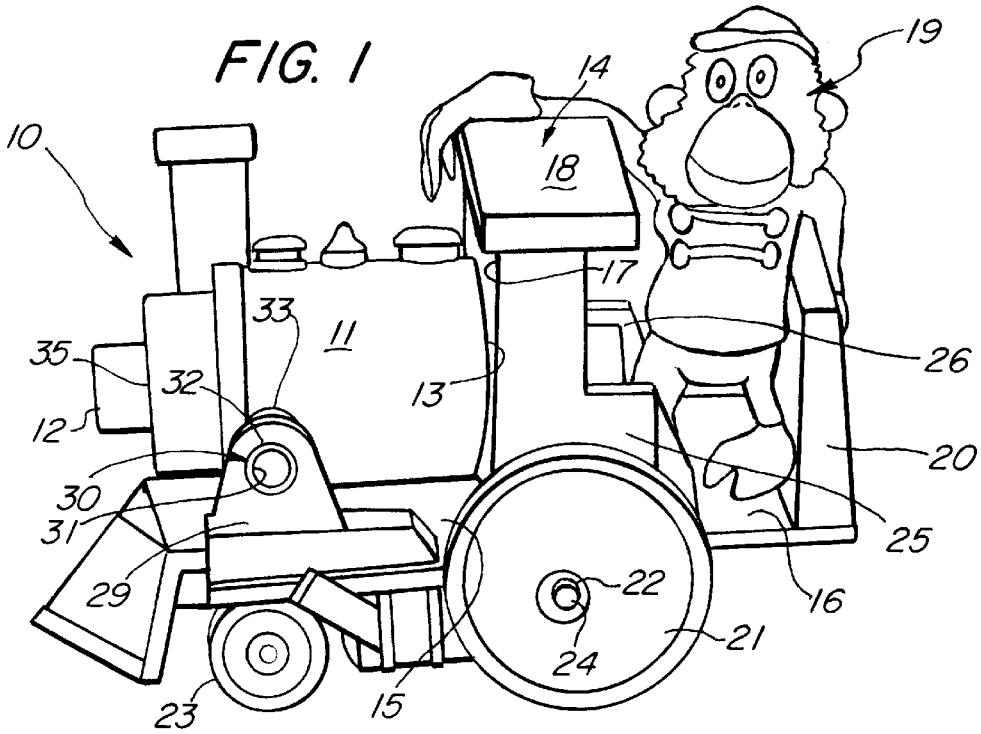
FIG. 1 sets forth a side perspective view of a toy locomotive constructed in accordance with the present invention.
Figure 2:
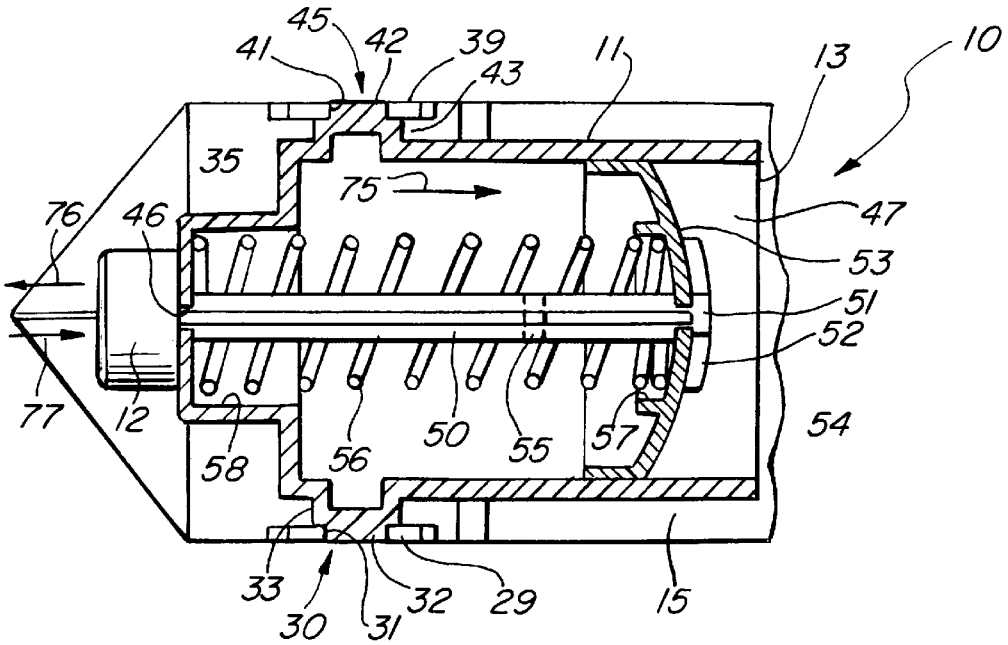
FIG. 2 sets forth a partially sectioned top view of the present invention toy locomotive.

FIG. 1 sets forth a side perspective view of a toy locomotive constructed in accordance with the present invention and generally referenced by numeral 10. Toy locomotive 10 is formed as a somewhat fanciful depiction of a steam locomotive. Thus, toy locomotive 10 includes a cylindrical portion 11 generally resembling the boiler structure of a steam locomotive. Cylinder 11 defines an end 13 and an end cap 35. End cap 35 is slightly reduced in diameter from the remainder of cylinder 11. A knob 12 which is as set forth below in FIG. 2 is secured to the outer end of a movable plunger defines a generally cylindrical shape. Toy locomotive 10 further includes a chassis 15 having a platform 16 upon which a toy FIG. 19 is resting. Chassis 15 further supports a vertically extending rail 20 which aids in supporting toy FIG. 19. A vertical flange 29 extends upwardly from one side of chassis 15 and defines an aperture 31 therein. Cylindrical portion 11 defines a spacer 33 and a post 32 extending outwardly to flange 29. Spacer 33 is larger in diameter than aperture 31 while post 32 is slightly smaller and therefore able to fit within aperture 31 of flange 29. As is better seen in FIG. 2, chassis 15 further defines a second flange 39 on the opposite side of chassis 15 from flange 29. By way of further similarity, flange 39 defines an aperture 41 which receives post 42 of cylindrical portion 11. A spacer 43 couples post 42 to cylindrical portion 11 in the same manner as spacer 33 couples post 32.

Returning to FIG. 1, the combined structure of cylindrical portion 11, end cap 35, and knob 12 is pivotally supported upon chassis 15 by the pivotal attachment 30 provided by flange 29, aperture 31, and post 32 of one side of locomotive 10 as well as flange 39, aperture 41 and post 42 providing pivotal attachment 45 on the opposite side of toy locomotive 10 (seen in FIG. 2).

Toy locomotive 10 further includes a cab portion 14 having a top 18 and a pair of side walls 25 and 26. By means set forth below in FIG. 3 in greater detail, platform 16 defines a pair of clasps aligned with side walls 25 and 26 configured to receive a portion of the lower edges of each side wall and secure cab 14 to platform 16 in a removable attachment. In the attachment shown in FIG. 1, cab 14 is positioned generally against end 13 of cylindrical portion 11 leaving a sufficient cab space for supporting toy FIG. 19 which may for example be a fanciful depiction of an animal or the like. Thus in the configuration shown in FIG. 1, toy locomotive 10 is able to be used in a conventional play pattern in which the child user grips a convenient portion of toy locomotive 10 and pushes the toy locomotive across a play surface.

FIG. 2 sets forth a partial section top view of toy locomotive 10. As described above, toy locomotive 10 includes a chassis 15 having a platform 16 and a pair of upwardly extending flanges 29 and 39. Flange 29 defines an aperture 31 while flange 39 defines an aperture 41.

A cylindrical portion 11 defines an end 13 and a cylinder bore 47. Cylindrical portion 11 further defines an extending spacer 33 and a post 32. Post 32 is received within aperture 31 and cooperates with flange 29 to provide pivotal attachment 30 between flange 29 and cylindrical portion 11. Similarly, cylindrical portion 11 includes an extending spacer 43 and a post 42 received within aperture 41 of flange 39. The cooperation of post 42 and aperture 41 within flange 39 provides pivotal attachment 45.

A piston 53 is received within cylinder bore 47 and is slidable therein. Piston 53 defines an aperture 54 at the approximate center of the piston. Piston 53 also defines an internal recess 57. An elongated plunger 50 which preferable forms a cruciform like shape includes an end 51 received within aperture 54 and secured to an attachment plate 52. An end cap 35 joined to cylindrical portion 11 defines an aperture 46. The outer end of plunger 50 extends through aperture 46 and is joined to a knob 12 using conventional fastening techniques such as a fastener or adhesive bonding or the like. End cap 35 defines a recess 58 which receives one end of a coil spring 56. Coil spring 56 encircles plunger 50 and extends from recess 58 of end cap 35 to recess 57 of piston 53. Spring 56 is captivated between piston 53 and end cap 35 and thus provides a spring force urging piston 53 in the direction indicated by arrow 75. Plunger 50 further defines a notch 55 which is as better seen in FIG. 3, is opened in a downward direction beneath plunger 50.

Figure 3:
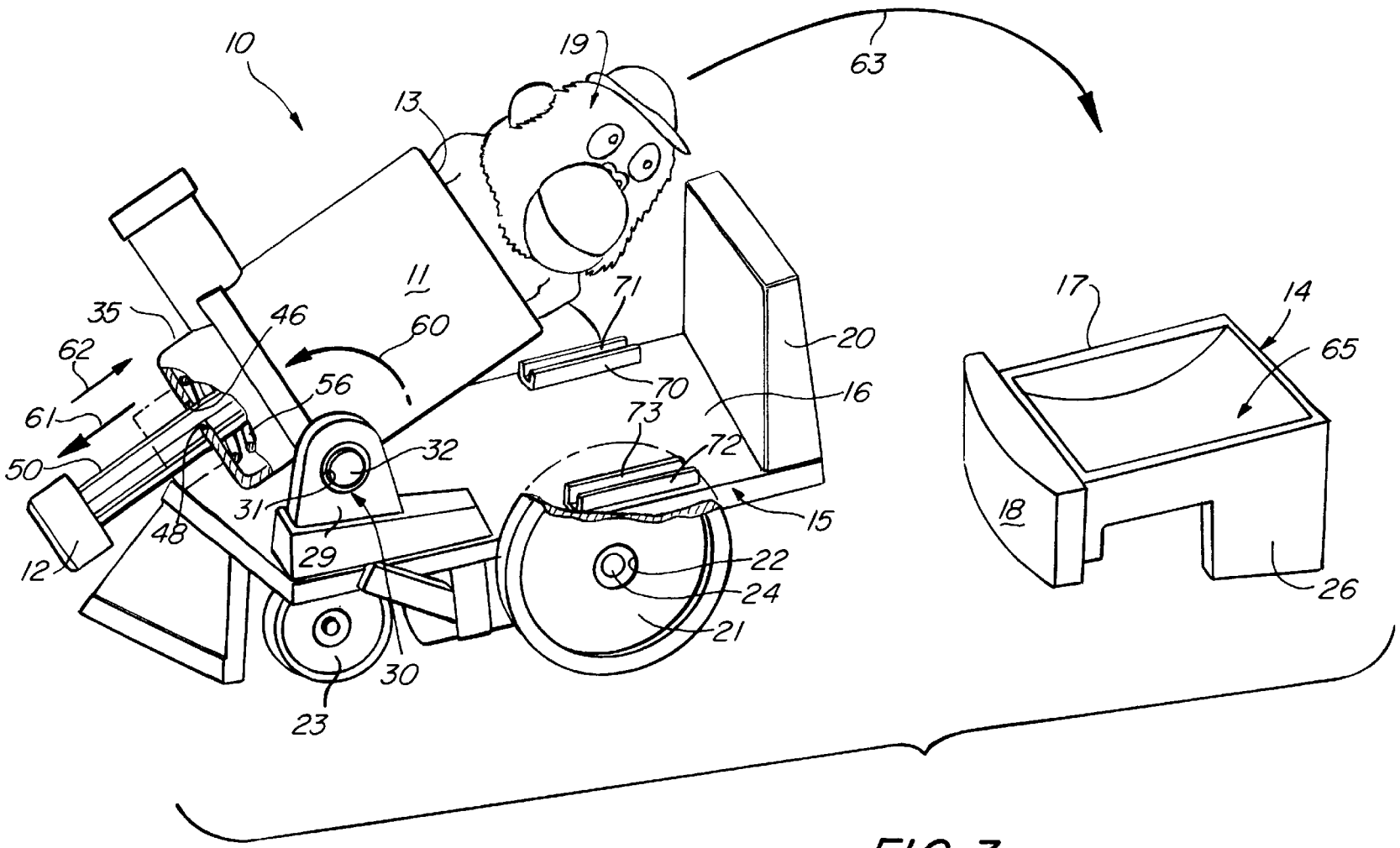
FIG. 3 sets forth a perspective view of the present invention toy locomotive in its alternate configuration.

In operation, the user is able to configure toy locomotive 10 in the alternate configuration shown in FIG. 3 for firing a "cannon" to launch toy FIG. 19. Thus with plunger 50, piston 53 and knob 12 in the position shown in FIG. 2, the user removes cab 14 (seen in FIG. 1) from chassis 15 and pivots cylindrical portion 11 upwardly through the desired angle for launching toy FIG. 19. Thereafter, the user draws knob 12 outwardly in the direction indicated by arrow 76 overcoming the force of spring 56 and drawing piston 53 inwardly until notch 55 is received within the lower portion of aperture 46 in the manner seen in FIG. 3. At this point a slight offset of knob 12 serves to latch plunger 50 within aperture 46 of end cap 35 storing energy in spring 56. A suitable projectile such as toy FIG. 19 may be placed within bore 47 and launched therefrom as the user moves plunger 50 by manipulating knob 12 away from the engagement of notch 55 and aperture 46. Once notch 55 has cleared, the stored energy within spring 56 rapidly accelerates piston 53 in the direction indicated by arrow 75 and draws knob 12 in the direction indicated by arrow 77. At this point a complete firing cycle has been completed. Toy locomotive 10 may then repeat the firing cycle or restore the toy to the locomotive configuration shown in FIG. 1.

FIG. 3 sets forth a partially sectioned perspective view of toy locomotive 10 configured in its alternated configuration to provided a projectile launcher "cannon". As described above, toy locomotive 10 includes a chassis 15 having a platform 16 formed thereon. Chassis 15 is supported by a plurality of wheels such as wheels 21 and 23. In the preferred fabrication of the present invention, one or more of the supporting wheels of chassis 15 includes an offset recess 22 within in which an axle 24 is supported. As a result, the offset attachment of wheels such as wheel 21 provides an eccentric action creating a wobbly movement of toy locomotive 10. Chassis 15 further supports an upwardly extending rail 20 and a pair of elongated clasps 70 and 72. Clasps 70 and 72 defined respective channels 71 and 73. Chassis 15 further includes a vertically extending flange 29 having an aperture 31 formed therein. As is better seen in FIG. 2, chassis 15 further defines a vertically extending flange 39 oppositely positioned from flange 29 and defining an aperture 41. Cylindrical portion 11 includes a post 32 received within aperture 31 to provide a pivotal attachment 30. As is better seen in FIG. 2, cylindrical portion 11 includes a post 42 received within aperture 41 of flange 39 to form pivot 45.

Cylindrical portion 11 defines an end 13 and as is better seen in FIG. 2 a cylinder bore 47. Cylindrical portion 11 is pivotally secured to chassis 15 and in the configuration of FIG. 3 is pivoted upwardly about pivots 30 and 45 (seen in FIG. 2) in the direction indicated by arrow 60. When used in the configuration shown in FIG. 3, cylindrical portion 11 forms the barrel of a projectile launching cannon having a bore which may receive a projectile such as toy FIG. 19. Cylindrical portion 11 defines an end cap 35 having an aperture 46 formed therein. An elongated preferably cruciform shaped plunger 50 supports a knob 12 at its outer end and as is better seen in FIG. 2 is secured to piston 53 at its interior end. Spring 56 is received upon plunger 50 and provides a spring force urging piston 53 (seen in FIG. 2) and plunger 50 in the direction indicated by arrow 62. Thus the launching mechanism of cylinder 11 is initially cocked by drawing 12 and plunger 50 outwardly in the direction indicated by arrow 61 through aperture 46 until notch 48 is aligned with aperture 46. The position of plunger 50 is latched by offsetting it slightly downwardly within aperture 46 allowing notch 48 to grip the underlying portion of end cap 35. At this point, piston 53 (seen in FIG. 2) has been drawn into cylindrical portion 11 leaving space for a projectile such as toy FIG. 19 to be inserted therein. Toy FIG. 19 may then be launched by disturbing the latch of notch 48 upon aperture 46 and allowing spring 56 to accelerate pin 53 (seen in FIG. 2) and plunger 50 rapidly in the direction indicated by arrow 62. As piston 53 (seen in FIG. 2) is driven against toy FIG. 19, the toy figure is launched in the direction indicated by arrow 63.

In accordance with further play pattern of the present invention, toy locomotive 10 includes a cab 14 which is securable in the manner shown in FIG. 1 by attachment to clasps 70 and 72 to provide a locomotive cab and which is useable as a target in the configuration of FIG. 3. Thus cab 14 includes a top 18, a pair of sidewalls 25 and 26 (sidewall 25 shown in FIG. 1) and a front edge 17. Cab 14 further defines a recess 65 which forms the intended target for launching toy FIG. 19. The entire assembly of toy locomotive 10 may be reversed by pivoting cylindrical portion 11 downwardly and by reattaching cab 14 using clasps 70 and 72 to provide the locomotive configuration shown in FIG. 1.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A transformable toy locomotive and toy figure in combination, said combination comprising:

a chassis having a plurality of rolling wheels thereon;

a cannon portion constructed to include a toy locomotive boiler, smoke stack and headlight knob, pivotally secured to said chassis movable between a first position lying upon said chassis and a second upwardly angled position, said cannon portion defining a cylindrical bore within said toy locomotive boiler;

a piston received within said cylindrical bore;

a plunger having a first end joined to said piston and a second end Joined to said headlight knob;

a spring coupled to said piston;

a cab secured to said chassis in a first position and removable from said chassis in a second position, said cab defining a recess constructed to function as a target in said second position; and a toy figure riding upon said chassis and being sized to function as a projectile receivable within said cylinder bore, said cab and said cannon portion cooperating to form a toy locomotive in their respective first positions and a cannon and target in their respective second configurations whereby said toy locomotive transforms from a toy locomotive having a toy figure thereon to a cannon for launching said toy figure and a target for receiving said toy figure.

2. The transformable toy locomotive set forth in claim 1 wherein said cannon portion defines an end cap having an aperture formed therein, said end cap forming a closed end for said cannon portion and said plunger extending through said aperture to engage said piston and said spring being captivate in said cylinder bore between said piston and said end cap.

3. The transformable toy locomotive set forth in claim 2 wherein said canon portion is generally cylindrical.

* * * * *